US009879188B2

(12) United States Patent
Koseoglu

(10) Patent No.: US 9,879,188 B2
(45) Date of Patent: Jan. 30, 2018

(54) INTEGRATED EBULLATED-BED HYDROPROCESSING, FIXED BED HYDROPROCESSING AND COKING PROCESS FOR WHOLE CRUDE OIL CONVERSION INTO HYDROTREATED DISTILLATES AND PETROLEUM GREEN COKE

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 5 days.

(21) Appl. No.: 15/220,840

(22) Filed: Jul. 27, 2016

(65) Prior Publication Data

US 2017/0029724 A1 Feb. 2, 2017

Related U.S. Application Data

(60) Provisional application No. 62/197,365, filed on Jul. 27, 2015.

(51) Int. Cl.

| | |
|---|---|
| ***C10G 45/14*** | (2006.01) |
| ***C10G 47/00*** | (2006.01) |
| ***C10G 65/12*** | (2006.01) |
| ***C10G 69/06*** | (2006.01) |
| ***C10B 55/00*** | (2006.01) |
| ***C10G 65/10*** | (2006.01) |
| ***C10G 69/00*** | (2006.01) |
| ***C10G 69/14*** | (2006.01) |
| ***C10G 9/00*** | (2006.01) |

(52) U.S. Cl.

CPC ..... *C10G 69/06* (2013.01); *C10B 55/00* (2013.01); *C10G 9/005* (2013.01); *C10G 65/10* (2013.01); *C10G 69/00* (2013.01); *C10G 69/14* (2013.01); *C10G 2300/202* (2013.01); *C10G 2300/4081* (2013.01)

(58) Field of Classification Search

CPC ..... C10G 45/14; C10G 47/00; C10G 65/12; C10G 69/06; C10G 2300/202; C10B 55/00

See application file for complete search history.

(56) References Cited

U.S. PATENT DOCUMENTS

| | | | |
|---|---|---|---|
| 2,738,964 | A | 3/1956 | Binder et al. |
| 2,987,465 | A | 6/1961 | Johanson |
| 3,151,060 | A | 9/1964 | Garbo |
| 3,617,524 | A | 11/1971 | Conn |
| 3,645,887 | A | 2/1972 | Mounce |
| 6,436,279 | B1 | 8/2002 | Colyar |
| 7,279,090 | B2 | 10/2007 | Colyar et al. |
| 7,901,569 | B2 | 3/2011 | Farshid et al. |
| 9,546,330 | B2 | 1/2017 | Koseoglu et al. |
| 2009/0139902 | A1 | 6/2009 | Kressmann et al. |
| 2010/0018904 | A1 | 1/2010 | Kressmann et al. |
| 2010/0025291 | A1 | 2/2010 | Shafi et al. |
| 2010/0025293 | A1 | 2/2010 | Kressmann et al. |
| 2011/0083996 | A1 | 4/2011 | Shafi et al. |
| 2011/0198265 | A1 | 8/2011 | Colvar et al. |
| 2011/0226666 | A1 | 9/2011 | Koseoglu et al. |
| 2013/0292299 | A1 | 11/2013 | Koseoglu et al. |
| 2014/0027344 | A1* | 1/2014 | Harris ..... C10G 47/12 208/61 |
| 2014/0275676 | A1 | 9/2014 | Sieli et al. |

FOREIGN PATENT DOCUMENTS

| | | | |
|---|---|---|---|
| JP | 2001055585 | A | 2/2001 |
| WO | 2009058785 | A2 | 5/2009 |

OTHER PUBLICATIONS

Rana, et al., "A review of recent advances on process technologies for upgrading of heavy oils and residue", ScienceDirect, Fuel 86, 2007, pp. 1216-1231.

Anonymous, "Axens hydrocracking—Excellence from innovation and experience", Axens, pp. 1-12, Dec. 31, 2011.

"Clarifying the Scope of Petroleum Hazardous Waste Listings: Supplemental Information Regarding Petroleum Hydroprocessing Units", Science Application Int'l Corp., Jun. 2001, 49 pgs.

Kunnas, et al., "Improving residue hydrocracking performance", PTQ: the refining, gas and petrochemical processing website, Q3, 2011, pp. 49-57.

Kunnas, et al., "Mitigate fouling in ebullated-bed hydrocrackers", Hydrocarbon Processing, Oct. 2010, 6 pgs.

Gunter, et al., "Oil Refining. Residue Conversion Processes", Ullmann's Encyclopedia of Inductiral Chemistry, vol. 25, pp. 231-240, Jan. 15, 2007, pp. 231-240.

Trecanni, "The Hydroconversion of Residues", Encyclopedia of Hydrocarbons, vol. II, 2007, pp. 309-323.

PCT/US2016/044211, International Search Report and Written Opinion dated Oct. 21, 2016, 11 pgs.

* cited by examiner

*Primary Examiner* — Randy Boyer

(74) *Attorney, Agent, or Firm* — Abelman, Frayne & Schwab

(57) ABSTRACT

A system and process for upgrading a whole crude oil feed in an integrated ebullated-bed and hydrotreater is provided in which the whole crude oil is flashed into a flashed straight run distillates fraction and an atmospheric residue fraction. The atmospheric residue fraction is hydroprocessed in an ebullated-bed reaction zone, while the flashed straight run distillates fraction and the products fraction produced from the ebullated-bed reaction zone are hydrotreated in a fixed-bed reaction zone. The unconverted residue fraction from the ebullated-bed reaction zone is processed in a coker unit to produce high quality petroleum green coke.

24 Claims, 1 Drawing Sheet

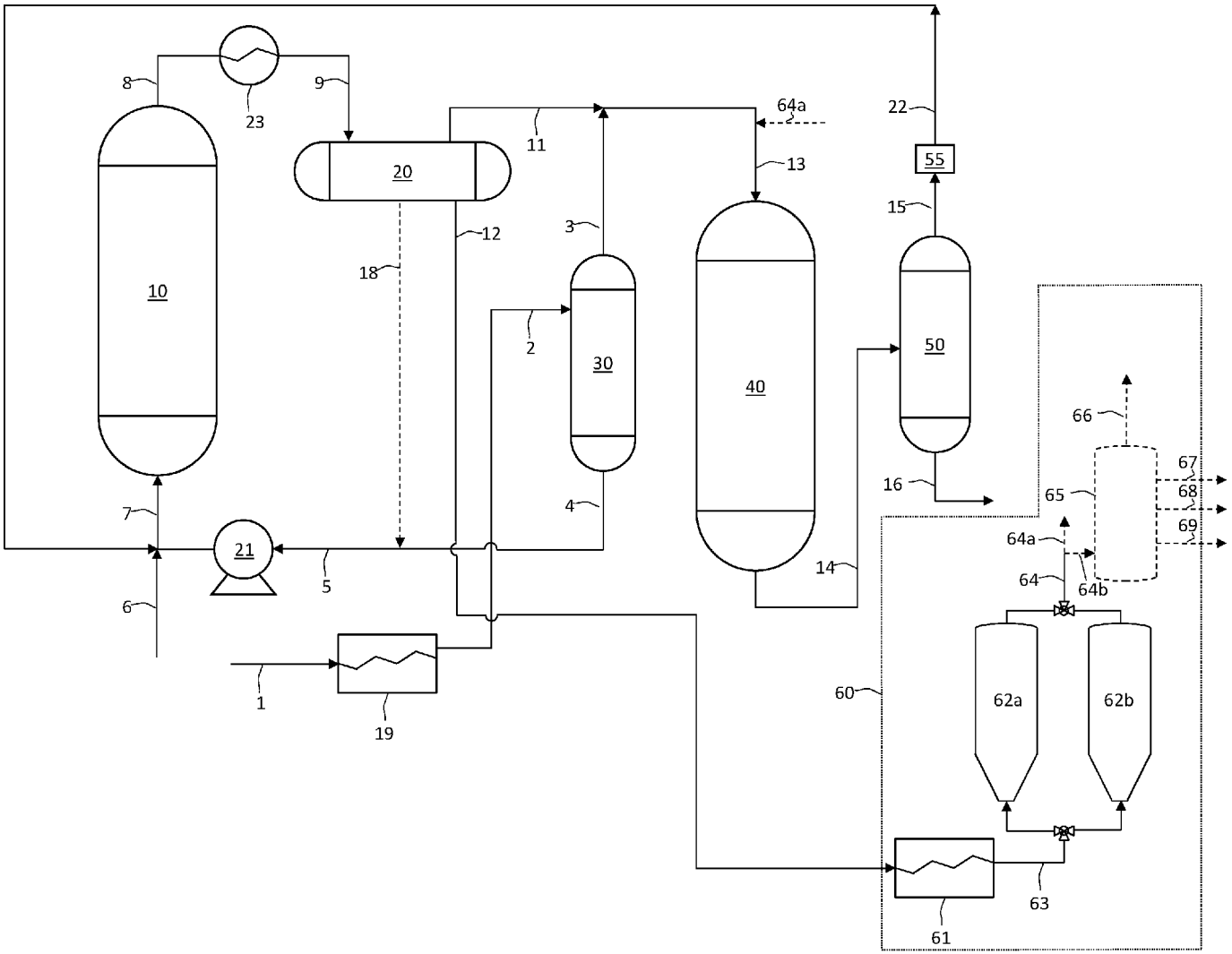
10
20
30
40
50
55
21
23
19
61
62a
62b
63
64
64a
64b
65
66
67
68
69
60
1
2
3
4
5
6
7
8
9
11
12
13
14
15
16
18
22

INTEGRATED EBULLATED-BED HYDROPROCESSING, FIXED BED HYDROPROCESSING AND COKING PROCESS FOR WHOLE CRUDE OIL CONVERSION INTO HYDROTREATED DISTILLATES AND PETROLEUM GREEN COKE

RELATED APPLICATIONS

This application claims the benefit of priority of U.S. Provisional Patent Application No. 62/197,365 filed Jul. 27, 2015, which is incorporated by reference herein.

FIELD OF THE INVENTION

This invention is directed to a process to upgrade whole crude oil, in particular to produce hydrotreated distillates, liquid and gas coking unit products, high quality petroleum green coke.

BACKGROUND

Crude oil is conventionally processed by distillation followed by various cracking, solvent treatment and hydroconversion processes to produce a desired slate of fuels, lubricating oil products, chemicals, chemical feedstocks and the like. An example of a conventional refinery process includes distillation of crude oil in an atmospheric distillation to recover gas oil, naphtha, gaseous products, and an atmospheric residuum. Streams recovered from crude distillation at the boiling point of fuels have customarily been used directly as fuels. Generally, the atmospheric residuum is further fractionated in a vacuum distillation unit to produce a vacuum gas oil and a vacuum residuum. The vacuum gas oil is commonly cracked to provide more valuable light transportation fuel products in a fluid catalytic cracking unit or by hydrocracking. The vacuum residuum can be further treated for conversion to more valuable products. For example, vacuum residuum upgrading processes can include one or more of residuum hydrotreating, residuum fluid catalytic cracking, coking, and solvent deasphalting.

There are generally three common reactor types used in the refining industry: fixed-bed, ebullated-bed, and moving-bed. The decision to use a particular type of reactor is based on a number of criteria including the type of feedstock, desired conversion percentage, flexibility, run length and product quality, among others. In a refinery, the down-time for replacement or renewal of catalyst must be as short as possible. Further, the economics of the process will generally depend upon the versatility of the system to handle feed streams containing varying amounts of contaminants such as sulfur, nitrogen, metals and/or organometallic compounds, such as those found in vacuum gas oil, deasphalted oil, and residues.

In a fixed-bed reactor, catalyst particles are stationary and do not move with respect to a fixed reference frame. Fixed-bed technologies have considerable problems in treating particularly heavy charges containing relatively high quantity of heteroatoms, metals and asphaltenes, as these contaminants cause the rapid deactivation of the catalyst and plugging of the reactor. In conventional fixed-bed reactors, the hydroprocessing catalysts are replaced regularly in order to maintain the desired level of catalyst activity and throughput. Multiple fixed-bed reactors connected in series can be used to achieve a relatively high conversion of heavy feedstocks boiling above a cut point in the range of about 300-400° C., but such designs require high capital investment and, for certain feedstocks, commercially impractical, for instance, catalysts replacement every 3-4 months.

The ebullated-bed reactor was developed to overcome plugging problems commonly associated with fixed-bed reactors during processing of relatively heavy feedstocks and as the conversion requirements increases, for instance, for vacuum residue. In general, an ebullated-bed reactor includes concurrently flowing streams of liquids or slurries of liquids, solids and gas, through a vertically-oriented cylindrical vessel containing catalyst. The catalyst is placed in motion in the liquid and has a gross volume dispersed through the liquid medium that is greater than the volume of the mass when stationary. In an ebullated-bed reactor, the catalyst is in an expanded bed, thereby countering plugging problems associated with fixed-bed reactors. The fluidized nature of the catalyst in an ebullated-bed reactor also allows for on-line catalyst replacement of a small portion of the bed. This results in a high net bed activity which does not vary with time. Early ebullated-bed processes and systems are described by Johanson in U.S. Pat. Nos. 2,987,465 and 3,197,288, both of which are incorporated by reference herein.

Moving-bed reactors combine certain advantages of fixed-bed operations and the relatively easy catalyst replacement of ebullated-bed technology. Operating conditions are generally more severe than those typically used in fixed-bed reactor, that is, the pressure can exceed 200 $Kg/cm^2$, and the temperature can be in the range of from 400° C.-430° C. During catalyst replacement, catalyst movement is slow compared to the linear velocity of the feed. Catalyst addition and withdrawal are performed, for instance, via a sluice system at the top and bottom of the reactor. The advantage of the moving-bed reactor is that the top layer of the moving-bed consists of fresh catalyst, and contaminants deposited on the top of the bed move downward with the catalyst and are released during catalyst withdrawal at the bottom. The tolerance to metals and other contaminants is therefore much greater than in a fixed-bed reactor. With this capability, the moving-bed reactor has advantages for hydroprocessing of very heavy feeds, especially when several reactors are combined in series.

Companies that develop ebullated-bed technology include: Chevron Lummus Global, Axens, Headwaters, Institut Francais du Petrole (IFP) Energies Nouvelles, Hydrocarbon Research Institute (HRI), City Services, Texaco, Hydrocarbon Technologies Inc. (HTI). The commercial names for the ebullated-bed technologies include: H-Oil, T-Star, and LC-Fining.

One major technical challenge posed when hydrotreating heavy oil fractions or whole crude oil is the effect of small concentrations of contaminants, such as, for example, organic nickel and vanadium compounds and poly-nuclear aromatic compounds. These organometallic compounds and others have been proven to reduce the activity or useful life of hydrotreating catalysts. The presence of such metal contaminants and poly-nuclear aromatics result in reduced process performance, increased capital costs and/or increased operating costs of refinery processing units. The metals in the residual fraction of the crude oil deposits on the hydroprocessing catalyst and results in catalyst deactivation. The poly-nuclear aromatic compounds are coke precursors and at high temperatures form coke, which also causes catalyst deactivation.

Heavier fractions from the atmospheric and vacuum distillation units can contain asphaltenes. Asphaltenes are solid in nature and comprise polynuclear aromatics, smaller aromatics and resin molecules. The chemical structures of asphaltenes are complex and include polynuclear hydrocarbons having molecular weights up to 20,000 joined by alkyl chains. Asphaltenes also include nitrogen, sulfur, oxygen and metals such as nickel and vanadium. They are present in crude oils and heavy fractions in varying quantities. Asphaltenes exist in small quantities in light crude oils, or not at all in all condensates or lighter fractions. However, they are present in relatively large quantities in heavy crude oils and petroleum fractions. Asphaltenes have been defined as the component of a heavy crude oil fraction that is precipitated by addition of a low-boiling paraffin solvent, or paraffin naphtha, such as normal pentane, and is soluble in carbon disulfide and benzene. In certain methods their concentrations are defined as the amount of asphaltenes precipitated by addition of an n-paraffin solvent to the feedstock, for instance, as prescribed in the Institute of Petroleum Method IP-143. The heavy fraction can contain asphaltenes when it is derived from carbonaceous sources such as petroleum, coal or oil shale. There is a close relationship between asphaltenes, resins and high molecular weight polycyclic hydrocarbons. Asphaltenes are hypothesized to be formed by the oxidation of natural resins. The hydrogenation of asphaltic compounds containing resins and asphaltenes produces heavy hydrocarbon oils, that is, resins and asphaltenes are hydrogenated into polycyclic aromatic or hydroaromatic hydrocarbons. They differ from polycyclic aromatic hydrocarbons by the presence of oxygen and sulfur in varied amounts.

Upon heating above about 300-400° C., asphaltenes generally do not melt but rather decompose, forming carbon and volatile products. They react with sulfuric acid to form sulfonic acids, as might be expected on the basis of the polyaromatic structure of these components. Flocs and aggregates of asphaltenes will result from the addition of non-polar solvents, for instance, paraffinic solvents, to crude oil and other heavy hydrocarbon oil feedstocks.

Conventional methods are limited in their efficacy for processing of whole crude oil feeds. For example, fixed-bed reactors require shut-down for catalyst unloading and replacement. This reduces the on stream factor and as a result increases the processing costs of the hydroprocessing units.

It is therefore desirable to provide an improved system and a process for efficient treatment of a whole crude oil to upgrade its quality.

SUMMARY OF THE DISCLOSURE

An integrated system and process is provided for upgrading a whole crude oil feedstock is provided to reduce the content of undesired heteroatom compounds containing metals, sulfur and nitrogen. The process comprises heating a crude oil feedstock; flashing the heated feedstock to produce a flashed straight run distillate fraction and an atmospheric residual fraction; hydroprocessing the atmospheric residual fraction in an ebullated-bed reaction zone in the presence of a first catalyst system (an ebullated-bed reactor catalyst) to produce an ebullated-bed reactor effluent; separating the ebullated-bed reactor effluent into hydroprocessed product also containing hydrogen, a recycle oil fraction and an unconverted residual fraction; hydrotreating a stream composed of the hydroprocessed product, the flashed straight run distillate fraction and optionally coker distillates, in the presence of a second catalyst system (hydrotreating catalyst) in a hydrotreating zone to produce a hydrotreated effluent; separating the hydrotreated effluent to produce a light gas fraction and a hydrotreated distillate fraction; purifying the light gas fraction and recycling the purified light gas fraction to the ebullated-bed reaction zone as a source of hydrogen gas for hydroprocessing; and optionally recycling the recycle oil stream to the ebullated-bed reaction zone. The unconverted residual fraction is processed in a coker unit to produce coker liquid and gas products, and petroleum green coke, for instance, high quality petroleum green coke suitable as raw material for production of fuel or anode grade coke.

In certain embodiments of the integrated process, which can be carried out within refinery limits, use of the unconverted residual fraction as feed to the coking unit enables recovery of high quality petroleum coke that can be used as raw material to produce low sulfur marketable grades of coke including anode grade coke (sponge) and/or electrode grade coke (needle).

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawing is included to provide illustration and a further understanding of the various aspects and embodiments. The drawing, together with the remainder of the specification, serves to explain principles and operations of the described and claimed aspects and embodiments.

BRIEF DESCRIPTION OF THE DRAWING

The foregoing summary, as well as the following detailed description will be best understood when read in conjunction with the attached drawing in which:

FIG. 1 is a process flow diagram of an integrated process of an ebullated-bed reactor and a fixed-bed reactor for the treatment of a whole crude oil.

DETAILED DESCRIPTION

The process and system herein facilitates production of hydrotreated products and high quality petroleum green coke. The process employs a combination of an ebullated-bed reaction zone; a fixed-bed reaction zone to desulfurize and hydroprocess (that is, hydrotreat and hydrocrack) a whole crude oil feedstock to form low sulfur, low aromatic fuels; and a coker zone to produce coke, and in certain embodiments anode grade coke or fuel grade coke. The whole crude oil is heated and separated into a flashed straight run distillates fraction and an atmospheric residue fraction. The atmospheric residue fraction is hydroprocessed in the ebullated-bed reactor, while the hydroprocessed products and the flashed straight run distillates fraction are combined and hydrotreated in the in-line fixed-bed reactor. In certain embodiments the fixed-bed reactor only receives hydrogen from the ebullated-bed reactor effluents. In further embodiments additional hydrogen for the fixed bed reactor is provided by a light gas stream derived from coker products. Unconverted residue is passed to a coker zone to produce coke, along with liquid and gas coker products.

In certain operations described herein, high quality petroleum coke can be recovered and used, for instance, as fuel grade coke or anode grade coke. In particular, anode grade coke is in high demand, for instance, in the electrode industry.

Unconverted residue is thermally cracked in a coking unit, such as a delayed coking unit. In contrast to typical coking operations in which the coke is low market value by-product, in the integrated process herein, high quality petroleum green coke recovered from the coker unit drums is low in sulfur and metals. The recovered high quality petroleum green coke can be used as high quality, low sulfur and metal content fuel grade (shot) coke, and/or a raw material for production of low sulfur and metal content marketable grades of coke including anode grade coke (sponge) and/or electrode grade coke (needle). Table 1 shows the properties of these types of coke. In accordance with certain embodiments of the process herein, calcination of the petroleum green coke recovered from the coking drums produces sponge and/or needle grade coke that is suitable for use in the aluminum and steel industries. Calcination occurs by thermal treatment to remove moisture and reduce the volatile combustible matter.

TABLE 1

| Property | Units | Fuel Coke | Calcined Sponge Coke | Calcined Needle Coke |
|---|---|---|---|---|
| Bulk Density | $Kg/m^3$ | 880 | 720-800 | 670-720 |
| Sulfur | W % (max) | 3.5-7.5 | 1.0-3.5 | 0.2-0.5 |
| Nitrogen | ppmw (max) | 6,000 | — | 50 |
| Nickel | ppmw (max) | 500 | 200 | 7 |
| Vanadium | ppmw | 150 | 350 | — |
| Volatile Combustible Material | W % (max) | 12 | 0.5 | 0.5 |
| Ash Content | W % (max) | 0.35 | 0.40 | 0.1 |
| Moisture Content | W % (max) | 8-12 | 0.3 | 0.1 |
| Hardgrove Grindability Index (HGI) | W % | 35-70 | 60-100 | — |
| Coefficient of thermal expansion, E + 7 | ° C. | — | — | 1-5 |

As used herein, "high quality petroleum green coke" refers to petroleum green coke recovered from a coker unit that when calcined, possesses the properties as in Table 1, and in certain embodiments possessing the properties in Table 1 concerning calcined sponge coke or calcined needle coke identified in Table 1.

As used herein, a process that operates "within the battery limits of a refinery" refers to a process that operates with a battery of unit operations along with their related utilities and services, distinguished from a process whereby effluent from a unit operation is collected, stored and/or transported to a separate unit operations or battery of unit operations.

The crude oil feed can be desalted and volatile materials removed prior to desulfurization. A substantial portion of the crude oil feed is subjected to desulfurization in a desulfurization reaction zone. A number of reactions are expected to occur during the desulfurization process. Metal-containing components of the crude oil feed are at least partially demetallized during the desulfurization process, and nitrogen and oxygen are removed, along with sulfur, during the desulfurization process.

Yields of desirable fuel products are increased in the present process when the desulfurized crude oil product is fractionated, preferably in a multi-stage fractionation zone having atmospheric and vacuum distillation columns. Products from multi-stage distillation include a naphtha fraction, a light gas oil fraction, a vacuum gas oil fraction and a residual fraction. The naphtha fraction boiling in the range 36° C.-180° C. can be upgraded in a reforming process to produce gasoline blending components. The light gas oil fraction, generally having a boiling of less than about 370° C., can be used directly as a fuel or further hydroconverted for improved fuel properties. In the present process, the vacuum gas oil fraction is hydrocracked to increase the fuel yield and to further improve fuel properties. Single or multi-stage hydrocracking reactors can be employed. The hydrocracked products include at least one low sulfur fuel product that can be recovered during distillation of the hydrocracked products.

Accordingly, a process is provided for hydrodesulfurizing a crude oil feed in a crude desulfurization unit, separating the desulfurized crude oil and isolating a naphtha fraction, a light gas oil fraction, a vacuum gas oil fraction and a residual fraction, hydrocracking the vacuum gas oil to form at least one low sulfur fuel product; and hydrotreating the light gas oil fraction. This entire integrated process, in certain embodiments, can be conducted without the need for tank storage of intermediate products, such as a desulfurized crude oil, the light gas oil fraction, and the vacuum gas oil fraction. Since there is no required tank storage of intermediate products, these processes can be conducted without conventional cooling of the intermediate products, thus reducing the operating cost of the process. A further attribute of the present process that contributes to the reduction in capital and operating costs relates to the hydroconversion steps, including crude desulfurization, in which hydrocracking and hydrotreating are conducted using a single hydrogen supply loop.

Accordingly, an integrated refining system and process is described for processing a whole crude, or a substantial portion of whole crude, into a full range of products at high selectivities and high yields of the desired products. The integrated process utilizes a series of reaction zones, each containing a catalyst of varying composition and properties, for successively converting progressively lighter and cleaner fuel products.

The integrated process further provides a method for isolating, purifying and providing hydrogen to the various conversion reaction zones through the use of a single hydrogen isolation and pressurization unit.

The integrated process permits more efficient use of a combination of units for reaction, product isolation, hydrogen isolation and recycle, and energy usage in the preparation of fuels from a crude oil feed. In the practice of the process, a wide range of fuel oil products can be effectively prepared with a comparatively small number of reaction vessels and product recovery vessels, and with a minimum number of supporting vessel for handling hydrogen and intermediate products. As a further benefit, the process can be conducted while employing a smaller number of operators as compared to processes of the prior art.

The present process is based on the combination of crude desulfurization tailored to a wide boiling range feed, followed by distillation to form a few distillate streams, and bulk upgrading in an integrated hydrocracking/hydrotreating process to form a wide range of useful fuel and lubricating oil base stock products. The present process provides an efficient and less costly alternative to the conventional refinery practice of separating a crude oil feed into a number of distillate and residuum fractions, each of which are processed individually in similar but separate upgrading processes.

Referring now to the embodiment schematically illustrated in FIG. 1, the process generally includes an ebullated-bed reaction zone 10, a fixed-bed hydroprocessing reaction zone 40 and a coking unit 60, which are integrated in a manner to efficiently obtain various products from a crude oil feedstream. A whole crude oil feedstream 1 is heated in a furnace 19 and the heated stream 2 is sent to a flash vessel 30 to produce a flashed straight run distillates fraction 3 and an atmospheric residue fraction 4. The atmospheric residue fraction 4 is conveyed, e.g. via an ebullating pump 21, to an ebullated-bed reaction zone 10 along with hydrogen (which can be recycle hydrogen 22 as described herein and optionally make-up hydrogen 6) in the presence of an ebullated-bed reactor catalyst where it is hydroprocessed to produce an ebullated-bed reactor effluent stream 8. Ebullated-bed reaction zone 10 can contain a single ebullated-bed reactor or multiple ebullated-bed reactors operated in series. In addition, while ebullating pump 21 is shown associated with the charge 4 to the ebullated-bed reaction zone 10, it is understood that a suitable ebullating pump can be associated with the recycle stream. In addition, the ebullated-bed reaction zone 10 can include ebullated bed reactors in which liquid is recycled internally with a recycle downcomer or in a configuration with external recycle.

The ebullated-bed reactor effluent stream 8 is typically cooled, for instance, via heat exchanger 23, and the cooled ebullated-bed reactor effluent stream 9 is separated in a separation unit 20 into a hydroprocessed product stream 11 containing hydrogen gas and material boiling in naphtha and gas oil range, an unconverted residue stream 12 and an optional recycle oil stream 18.

The hydroprocessed product stream 11 and the flashed straight run distillates fraction 3 are combined as a stream 13 and hydrotreated in a fixed-bed hydroprocessing reaction zone 40 in the presence of a hydrotreating catalyst to produce a hydrotreated effluent 14. In certain embodiments, stream 13 also includes all or a portion of the liquid and stream 64, identified in FIG. 1 as stream 64*a*, which is derived from the coker unit 60. These additional components from the coker unit 60 can be hydrotreated in unit 40 along with the hydroprocessed product stream 11 and the flashed straight run distillates fraction 3. In further embodiments (not shown) all or a portion of one or more fractionated product streams from a coking product fractionator 65 can be incorporated with stream 13, including all or a portion of a light gas stream 66, all or a portion of a coker naphtha stream 67, all or a portion of a light coker gas oil stream 68, and/or all or a portion of a heavy coker gas oil stream 69. Fixed-bed hydroprocessing reaction zone 40 can contain a single fixed-bed reactor or multiple fixed-bed reactors operated in series. The hydrotreated effluent stream 14 is separated into a light gas stream 15 and a hydrotreated distillate stream 16 in a separation zone 50. The light gas stream 15 is purified, for instance, in a zone 55, and recycle hydrogen 22 is conveyed to the ebullated-bed reactor.

Recycle oil stream 18 is optionally recycled to the ebullated-bed reactor 10 for further processing, for instance, by combining recycle oil stream 18 with the atmospheric residue fraction from flash vessel 30 to form a combined stream 5 which is conveyed via ebullating pump 21.

The unconverted residue stream 12 is charged to a coking unit 60. In certain embodiments, coking unit 60 is a delayed coker unit, in which stream 12 is charged to a coking furnace 61 where the contents are rapidly heated to a coking temperature in the range of 480° to 530° C. and then fed to a coking drum 62*a* or 62*b*. Coking unit 60 can be configured with two or more parallel drums 62*a* and 62*b* and can be operated in a swing mode, such that when one of the drums is filled with coke, stream 12 is transferred to the empty parallel drum and recover coke, in certain embodiments anode grade coke, from the filled drum. Liquid and gas stream 64 from the coker drum 62*a* or 62*b* are recovered, can be recycled to the fixed-bed hydroprocessing reaction zone 40 and/or passed to a coking product fractionator 65.

Any hydrocarbon vapors remaining in the coke drum are removed by steam injection. The coke is cooled with water and then removed from the coke drum using hydraulic and/or mechanical means. In certain embodiments according to the system and process herein, this recovered coke is fuel grade coke or anode grade coke.

All or a portion 64*a* of the liquid and gas coking unit product stream 64 can be recycled to the liquid and gas coking unit product stream 64. In certain embodiments, all or a portion 64*b* of the liquid and gas coking unit product stream 64 is introduced into a coking product stream fractionator 65. The coking product stream 64*b* is fractionated to yield separate product streams that can include a light gas stream 66, a coker naphtha stream 67, a light coker gas oil stream 68 and a heavy coker gas oil stream 69, each of which are recovered from the fractionator. In certain embodiments, as discussed herein, all or a portion of each of these streams can be hydrotreated in unit 40.

Advantageously, the integrated processes herein facilitate recovery of such high quality petroleum green coke since the feed to the delayed coking unit has desirable qualities. In particular, the hydroprocessing unit bottoms stream in the present process is characterized by a sulfur content of generally less than about 3.5 wt %, in certain embodiments less than about 2.5 wt % and in further embodiments less than about 1 wt %, and a metals content of less than about 700 ppmw, in certain embodiments less than about 400 ppmw and in further embodiments less than about 100 ppmw. Use of this feedstream results in a high quality petroleum coke product that can be used as raw material to produce low sulfur marketable grades of coke including anode grade coke (sponge) and/or electrode grade coke (needle), in an efficient integrated process.

Coking is a carbon rejection process in which low-value atmospheric or vacuum distillation bottoms are converted to lighter products which in turn can be hydrotreated to produce transportation fuels, such as gasoline and diesel. Conventionally, coking of residuum from heavy high sulfur, or sour, crude oils is carried out primarily as a means of utilizing such low value hydrocarbon streams by converting part of the material to more valuable liquid and gas products. Typical coking processes include delayed coking and fluid coking.

In the delayed coking process, feedstock is typically introduced into a lower portion of a coking feed fractionator where one or more lighter materials are recovered as one or more top fractions, and bottoms are passed to a coking furnace. In the furnace bottoms from the fractionator and optionally heavy recycle material are mixed and rapidly heated in a coking furnace to a coking temperature, for instance, in the range of 480° C. to 530° C., and then fed to a coking drum. The hot mixed fresh and recycle feedstream is maintained in the coke drum at coking conditions of temperature and pressure where the feed decomposes or cracks to form coke and volatile components.

Table 2 provides delayed coker operating conditions for production of certain grades of petroleum green coke in the process herein:

TABLE 2

| Variable | Unit | Fuel Coke | Sponge Coke | Needle Coke |
|---|---|---|---|---|
| Temperature | ° C. | 488-500 | 496-510 | 496-510 |
| Pressure | $Kg/cm^2$ | 1 | 1.2-4.1 | 3.4-6.2 |
| Recycle Ratio | % | 0-5 | 0-50 | 60-120 |
| Coking time | hours | 9-18 | 24 | 36 |

The volatile components are recovered as vapor and transferred to a coking product fractionator. One or more heavy fractions of the coke drum vapors can be condensed, e.g. quenching or heat exchange. In certain embodiments the contact the coke drum vapors are contacted with heavy gas oil in the coking unit product fractionator, and heavy fractions form all or part of a recycle oil stream having condensed coking unit product vapors and heavy gas oil. In certain embodiments, heavy gas oil from the coking feed fractionator is added to the flash zone of the fractionator to condense the heaviest components from the coking unit product vapors.

Coking units are typically configured with two parallel drums and operated in a swing mode. When the coke drum is full of coke, the feed is switched to another drum, and the full drum is cooled. Liquid and gas streams from the coke drum are passed to a coking product fractionator for recovery. Any hydrocarbon vapors remaining in the coke drum are removed by steam injection. The coke remaining in the drum is typically cooled with water and then removed from the coke drum by conventional methods, for instance, using hydraulic and/or mechanical techniques to remove green coke from the drum walls for recovery.

Recovered petroleum green coke is suitable for production of marketable coke, and in particular anode (sponge) grade coke effective for use in the aluminum industry, or electrode (needle) grade coke effective for use in the steel industry. In the delayed coking production of high quality petroleum green coke, unconverted pitch and volatile combustible matter content of the green coke intermediate product subjected to calcination should be no more than about 15 percent by weight, and preferably in the range of 6 to 12 percent by weight.

In certain embodiments, one or more catalysts and additives can be added to the fresh feed and/or the fresh and recycle oil mixture prior to heating the feedstream in the coking unit furnace. The catalyst can promote cracking of the heavy hydrocarbon compounds and promote formation of the more valuable liquids that can be subjected to hydrotreating processes downstream to form transportation fuels. The catalyst and any additive(s) remain in the coking unit drum with the coke if they are solids, or are present on a solid carrier. If the catalyst(s) and/or additive(s) are soluble in the oil, they are carried with the vapors and remain in the liquid products. Note that in the production of high quality petroleum green coke, catalyst(s) and/or additive(s) which are soluble in the oil can be favored in certain embodiments to minimize contamination of the coke.

The current process utilizes certain features of ebullated-bed reactors to enhance hydroprocessing of the crude oil. The crude oil is flashed into two fractions and each fraction is desulfurized separately: atmospheric residue in the ebullated-bed reactor and the distillates in the fixed-bed reactor. One benefit derived from the integrated system and process using two different reactor types is the overall reduction in reactor volume. It provides the flexibility and latitude for a refiner either to operate at isothroughput or to decrease the size of the reactors.

Furthermore, in the arrangement of the present process, make-up hydrogen is only used in the ebullated-bed reactor. The hydroprocessed product stream 11 from the ebullated-bed reactor includes off-gasses containing hydrogen, which serves and the reactant hydrogen in the fixed-bed reaction zone 40.

The present process uses an ebullated-bed reaction zone 10 for whole crude oil upgrading and in-line hydrogen partial pressure to upgrade the distillates in a fixed-bed reaction zone 40. Separation of distillates from whole crude oil minimizes cracking of distillates and results in higher distillate yield in downstream refinery operations. Contaminants such as metals and asphaltenes are removed and/or converted in the ebullated-bed reactor, to which catalyst is added and/or withdrawn on-line, for instance, daily or at certain throughput intervals.

The integration of dual reactors for upgrading of whole crude oil further allows for production of high quality hydrotreated distillates and marketable coke. Due to heavy and dirty nature of the feedstock, that is, asphaltenes and metals contents, an ebullated-bed reactor is used to process hydrocarbons boiling above a cut point in the range 300-400° C., for instance, at or above 370° C., and distillates boiling below a cut point in the range 300-400° C., for instance, at or below 370° C., are treated in a fixed-bed reactor with the hydrogen source derived from the ebullated-bed reactor off-gas stream. The ebullated-bed reactor is a catalyst replacement system and therefore metals are removed from the whole crude oil in the ebullated bed-reactor. The unconverted residue from the ebullated bed-reactor, which serves as the feed to the coker unit, permits production of marketable coke having low sulfur content.

Operating conditions for the ebullated-bed reactor(s) include a total pressure of between about 100 bars and about 200 bars; an operating temperature of between about 350° C. and about 500, in certain embodiments between about 380° C. and about 450° C.; a liquid hourly space velocity of between about 0.1 $h^{-1}$ and about 2.0 $h^{-1}$; a hydrogen-feed ratio of between about 700 standard liter per liter of feed and about 2,500 standard liter per liter of feed; and a catalyst replacement rate of between about 0.1 $Kg/m^3$ of feed and about 5 $Kg/m^3$ of feed.

The catalyst employed in the ebullated-bed reactor can be a catalyst capable of facilitating the desired removal and/or conversion of contaminates in the relatively heavy portion of the feed. A suitable ebullated-bed reactor catalyst generally contains 2-25 wt % of total active metals, in certain embodiments 5-20 wt % active metals; possesses a total pore volume of 0.30-1.50 cc/gm; possesses a total surface area of 100-400 $m^2/g$; and/or possesses an average pore diameter of at least 50 angstrom. Suitable active metals include those selected from the group consisting of Elements Group VIB, VIIB or VIIIB of the Periodic Table. For instance, suitable metals include one or more of cobalt, nickel, tungsten and molybdenum. The support material can be selected from the group consisting of alumina, silica alumina, silica, and zeolites.

Operating conditions for the fixed-bed reactor(s) include a total pressure of between about 70 bars and about 200 bars, in certain embodiments between about 70 bars and about 150 bars; an operating temperature of between about 350° C. and about 450° C.; a liquid hourly space velocity of between about 0.5 $h^{-1}$ and about 2.0 $h^{-1}$; and a hydrogen-feed ratio of between about 700 standard liter per liter of feed and about 2,500 standard liter per liter of feed.

The catalyst employed in the fixed-bed reactor can be a catalyst capable of facilitating the desired hydrotreating of the relatively light portion of the feed. A suitable fixed-bed reactor catalyst generally contains 2-25 wt % of total active metals, in certain embodiments 5-20 wt % active metals; possesses a total pore volume of 0.30-1.50 cc/gm; possesses a total surface area of 100-400 $m^2/g$; and/or possesses an average pore diameter of at least 50 angstrom. Suitable active metals include those selected from the group consisting of Elements Group VIB, VIIB or VIIIB of the Periodic Table. For instance, suitable metals include one or more of cobalt, nickel, tungsten and molybdenum. The support material can be selected from the group consisting of alumina, silica alumina, silica, and zeolites.

EXAMPLE

A sample of 1000 Kg of Arab light crude oil is heated and flashed in an atmospheric flash unit, resulting in a straight run distillates fraction and an atmospheric residue fraction. The properties of the whole crude oil and its fractions are given in Table 3.

TABLE 3

Properties of Arab light crude oil and its fractions

| Fraction | Whole Crude Oil | Distillates | Atmospheric Residue |
|---|---|---|---|
| Yield Weight % | 100.0 | 57.3 | 42.7 |
| Yield Volume % | 100.0 | 62.3 | 37.7 |
| Gravity, ° API | 33.2 | 49.4 | 15.0 |
| Gravity, Specific 60/60° F. | 0.859 | 0.782 | 0.966 |
| Sulfur, W % | 1.97 | 0.75 | 3.21 |

The atmospheric residue fraction is mixed with hydrogen and sent to an ebullated-bed reactor operating at 440° C., 160 bars of hydrogen partial pressure, liquid hourly space velocity of 0.2 $h^{-1}$, catalyst replacement rate of 0.86 Kg catalyst/$m^3$ of oil. The ebullated-bed reactor has an external recycle vessel, from which the unconverted oil is recycled back to the reactor at a recycle to feed ratio of 6.

The unconverted residue is introduced into a coking unit and subjected to delayed coking at a coking furnace outlet temperature of 496° C. and atmospheric pressure. The delayed coking unit yielded an anode grade coke having 2.5 W % of sulfur and 19 ppmw of metals.

The straight run distillates fraction from the flash vessel, the hydrotreated distillates containing hydrogen and light gases coming from the ebullated-bed unit are combined and sent to the distillate hydrotreating unit containing Ni—Mo on Alumina catalyst. No additional hydrogen was injected as the hydrogen partial pressure from the ebullated-bed unit is sufficient for hydrotreating reactor. The hydrotreater was operated at 380° C., liquid hourly space velocity of 1 $h^{-1}$. The process material balance is given in Table 4.

TABLE 4

Material Balance

| Stream Name | Stream # | Flow, Kg/h | Density, Kg/L | API Gravity, ° | Sulfur, ppmw |
|---|---|---|---|---|---|
| Whole Crude Oil | 1 | 1,000 | 0.859 | 33.1 | 19,732 |
| Heated Whole Crude Oil | 2 | 1,000 | 0.859 | 33.1 | 19,732 |
| Distillates | 3 | 623 | 0.782 | 49.4 | 10 |
| Atmospheric Residue (AR) | 4 | 377 | 0.966 | 15.0 | 32,100 |
| AR + External Recycle | 5 | 2,639 | 1.031 | 5.7 | 12,000 |
| Make-up Hydrogen | 6 | 15 | | | |
| Reactor Inlet | 7 | 2,655 | 1.031 | 5.7 | 12,000 |

TABLE 4-continued

Material Balance

| Stream Name | Stream # | Flow, Kg/h | Density, Kg/L | API Gravity, ° | Sulfur, ppmw |
|---|---|---|---|---|---|
| Reactor Outlet | 8 | 2,655 | 0.966 | 15 | 6500 |
| Cooled Reactor Effluent | 9 | 2,655 | 0.966 | 15 | 6500 |
| External Recycle | 18 | 2,262 | 0.966 | 15.0 | 6500 |
| Hydrocracked Products | 11 | 147 | 0.815 | 42.1 | 1,259 |
| Unconverted Residue | 12 | 245 | 0.966 | 15.0 | 12,000 |
| Hydrotreater Inlet | 13 | 770 | 0.788 | 48.0 | 643 |
| Hydrotreater Outlet | 14 | 770 | — | — | 10 |
| Light Gases | 15 | 39 | — | — | — |
| Hydrotreated Distillates | 16 | 732 | 0.768 | 52.6 | 10 |
| Light Gases | 66 | 20 | — | — | |
| Coker Naphtha | 67 | 31 | | | |
| Light Coker Gas Oil | 68 | 93 | | | |
| Heavy Coker Gas Oil | 69 | 88 | | | |
| Anode Grade Coke | — | 14 | — | — | — |

Petroleum green coke recovered from a delayed coker unit is subjected to calcination. In particular, samples of about 3 kg of Petroleum green coke were calcined according to the following heat-up program: Room Temperature to 200° C. at 200° C./h heating rate; 200° C. to 800° C. at 30° C./h heating rate; 800° C. to 1100° C. at 50° C./h heating rate; Soaking Time at 1,100° C.: 20 h. Table 5 shows the properties of the samples of petroleum green coke and Table 6 shows the properties of the calcium samples.

TABLE 5

| Property | Method | Unit | Range | Sample 1 | Sample 2 |
|---|---|---|---|---|---|
| Water Content | ISO 11412 | % | 6.0-15.0 | 0.0 | 0.0 |
| Volatile Matter | ISO 9406 | % | 8.0-12.0 | 4.8 | 5.9 |
| Hardgrove Grindability Index | ISO 5074 | — | 60-100 | 41 | 50 |
| Ash Content | ISO 8005 | % | 0.10-0.30 | 0.08 | 0.08 |

TABLE 6

| Property | Method | Unit | Range | Sample 1 | Sample 2 |
|---|---|---|---|---|---|
| Water Content | ISO 11412 | % | 0.0-0.2 | 0.0 | 0.0 |
| Volatile Matter | ISO 9406 | % | 0.0-0.5 | 0.3 | 0.5 |
| Hardgrove Grindability Index | ISO 5074 | — | — | 41 | 49 |
| Ash Content | ISO 8005 | % | 0.10-0.30 | 0.04 | 0.07 |

The methods and systems of the present invention have been described above and in the attached drawing; however, modifications will be apparent to those of ordinary skill in the art and the scope of protection for the invention is to be defined by the claims that follow.

The invention claimed is:

1. A method for upgrading a crude oil feed to reduce the content of undesired heteroatom compounds containing metals, sulfur and nitrogen, the method comprising:

a. heating the crude oil feed and flashing the heated crude oil feed to produce a flashed straight run distillate fraction and an atmospheric residue fraction;

b. hydroprocessing the atmospheric residue fraction in an ebullated-bed reaction zone in the presence of hydrogen and an ebullated-bed reactor catalyst to produce a desulfurized and demetallized ebullated-bed reactor effluent stream, wherein make-up hydrogen is introduced as needed;

c. separating the ebullated-bed reactor effluent stream into a hydroprocessed products stream containing hydrogen, a recycle oil stream and an unconverted residue stream;

d. hydrotreating in a fixed bed hydroprocessing zone a combined stream of the hydroprocessed products stream containing hydrogen and the flashed straight run distillate fraction in the presence of a hydrotreating catalyst in a hydrotreater to produce a hydrotreated effluent, wherein hydrogen from the hydroprocessed products stream forms at least a portion of the requisite hydrogen for hydrotreating reactions;

e. separating the hydrotreated effluents to produce a light gas stream and a hydrotreated distillate stream;

f. purifying the light gas stream and recycling the purified light gas stream to the ebullated-bed reactor as a source of hydrogen gas for hydroprocessing;

g. passing the unconverted residue stream to a coker unit including a coker furnace and at least one coker drum to produce liquid and gas coker products as an effluent stream and recovering petroleum green coke from the coker drum.

2. The process as in claim 1, further comprising passing at least a portion of the liquid and gas coker products to step (d).

3. The process as in claim 1, further comprising passing at least a portion of the liquid and gas coker products to a coking product fractionator to separate a light gas stream, a coker naphtha stream, a light coker gas oil stream and a heavy coker gas oil stream.

4. The process as in claim 3, further comprising passing all or a portion of the light gas stream to step (d).

5. The process as in claim 3, further comprising passing all or a portion of the coker naphtha stream to step (d).

6. The process as in claim 3, further comprising passing all or a portion of the light coker gas oil stream to step (d).

7. The process as in claim 3, further comprising passing all or a portion of the heavy coker gas oil stream to step (d).

8. The process of any claim 1 wherein the coke has bulk density in the range 720-800 $Kg/m^3$.

9. The process of claim 1 wherein the coke contains sulfur in the range 1 to 2.5 W %.

10. The process of claim 1 wherein the coke contains nickel up to 200 ppmw.

11. The process of claim 1 wherein the coke contains vanadium up to 350 ppmw.

12. The process of claim 1 wherein the coke contains volatile combustible material up to 0.5 W %.

13. The process of claim 1 wherein the coker unit is a delayed coker unit.

14. The process of claim 13, wherein the coker unit is configured with two or more parallel drums and is operated in a swing mode, and wherein the process is continuous.

15. The process of claim 13, wherein the petroleum green coke recovered from the coker drum effective raw material for calcination into anode grade coke (sponge) or electrode grade coke (needle).

16. The process of claim 1 wherein the unconverted residue stream produced in step (c) and used in step (g) contains less than 2.5 W % sulfur.

17. The process of claim 1, wherein the unconverted residue stream produced in step (c) and used in step (g) contains less than 700 ppmw metal.

18. The process of claim 1, further comprising recycling the recycle oil stream to the ebullated-bed reaction zone.

19. The process of claim 1, wherein the hydrogen contained in the hydroprocessed products stream is the sole source of hydrogen for hydrotreatment in the fixed bed hydroprocessing zone.

20. The process of claim 1, wherein the flashed straight run distillates contain naphtha and gas oil fraction boiling below a cut point in the range of 300° C.-400° C.

21. The process of claim 1, wherein the ebullated-bed reaction zone contains single or multiple ebullated-bed reactors operated in series.

22. The process of claim 21, wherein operating conditions for the ebullated-bed reactor(s) include a total pressure of between about 100 bars and about 200 bars;

an operating temperature of between about 380° C. and about 450° C.;

a liquid hourly space velocity of between about 0.1 $h^{-1}$ and about 2.0 $h^{-1}$;

a hydrogen-feed ratio of between about 700 standard liter per liter of feed and about 2,500 standard liter per liter of feed; and a catalyst replacement rate of between about 0.1 $Kg/m^3$ of feed and about 5 $Kg/m^3$ of feed.

23. The process of claim 1, wherein the fixed bed hydroprocessing zone contains single or multiple fixed-bed reactors operated in series.

24. The process of claim 23, wherein operating conditions for the fixed-bed reactor(s) include a total pressure of between about 700 bars and about 150 bars;

an operating temperature of between about 350° C. and about 450° C.;

a liquid hourly space velocity of between about 0.5 $h^{-1}$ and about 2.0 $h^{-1}$; and a hydrogen-feed ratio of between about 700 standard liter per liter of feed and about 2,500 standard liter per liter of feed.

* * * * *